United States Patent [19]

Hay

[11] 4,078,614

[45] Mar. 14, 1978

[54] FIRE EXTINGUISHER

[76] Inventor: George P. Hay, P.O. Box 587, Springfield, Mo. 65801

[21] Appl. No.: 671,170

[22] Filed: Mar. 29, 1976

[51] Int. Cl.[2] ..... A62C 37/06

[52] U.S. Cl. ..... 169/9; 169/18; 251/41

[58] Field of Search ..... 169/9, 16, 18, 71, 75, 169/77, 43, 46, 47, 44; 239/307, 308, 337, 373; 222/394, 396, 397, 400.5, 189, 402.1, 402.15; 73/420, 115, 119 R; 251/41

[56] References Cited

U.S. PATENT DOCUMENTS

| | | | |
|---|---|---|---|
| 868,218 | 10/1907 | Osborne | 169/9 |
| 1,296,671 | 3/1919 | Lawson | 169/9 |
| 2,624,365 | 1/1953 | Hesson | 251/41 |
| 2,683,580 | 7/1954 | Griswold | 251/41 X |
| 2,758,657 | 8/1956 | Williamson et al. | 169/9 |
| 2,764,246 | 9/1956 | Emmrich et al. | 169/9 X |
| 2,818,121 | 12/1957 | Clifford et al. | 169/9 |
| 2,923,360 | 2/1960 | Porter | 169/9 X |
| 2,960,369 | 11/1960 | Goldie | 169/9 X |
| 3,198,015 | 8/1965 | Smith | 73/420 |
| 3,251,419 | 5/1966 | Howard | 169/9 |
| 3,949,812 | 4/1976 | Hay | 169/9 X |

*Primary Examiner*—John J. Love
*Assistant Examiner*—Michael Mar
*Attorney, Agent, or Firm*—F. Travers Burgess

[57] ABSTRACT

A fire extinguisher includes a pressure vessel containing an extinguishing agent and pressurized gas and a valve remotely operated by a manual control at the outlet end of the delivery hose for controlling the discharge of the extinguishing agent from the pressure vessel to the delivery hose. This discharge control valve is opened and closed by a pneumatic cylinder operated by pressurized gas from a valve pneumatically operated by a manually actuated valve mounted near the outlet end of the delivery hose. For purging the hose of accumulated dry chemical, a second valve is positioned in the discharge conduit between the discharge control valve and the hose and is arranged to open and close simultaneously with the main discharge valve responsive to actuation of the valve at the outlet end of the discharge hose; a second manually actuated valve is provided to permit the second valve in the discharge conduit to be opened even though the main discharge valve is closed, and there is a gas pressure line from the pressure vessel to the discharge conduit between the main discharge control valve and the second control valve therein whereby gas pressure from the vessel is introduced into the discharge conduit when the main valve therein is closed to purge the discharge hose of dry chemical therein and to fluidize dry chemical in the discharge conduit when the main valve is open. The system also includes a three-way manually actuated vent valve in the line connecting the pressure vessel to the pressure gauge whereby prior to testing pressure the pressure gauge can be exhausted and sticking eliminated, so as to assure an accurate pressure reading at any time.

12 Claims, 1 Drawing Figure

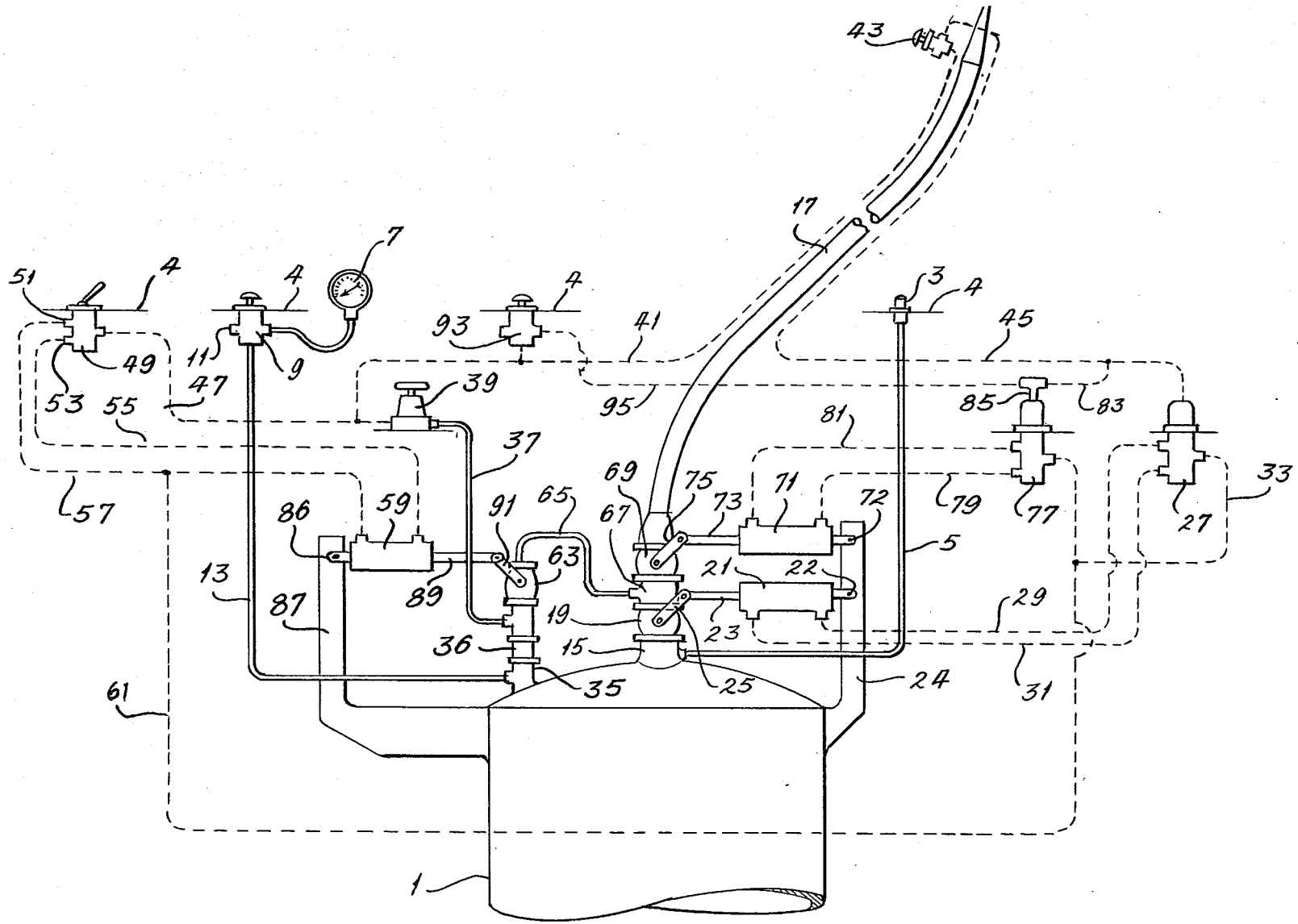
33
27
83
77
85
45
29
31
4
3
79
5
24
43
72
81
22
17
71
21
23
25
73
75
41
95
69
67
19
15
35
65
63
4
91
37
93
39
36
89
1
7
59
86
87
4
9
11
47
13
4
49
55
53
57
61
51

FIRE EXTINGUISHER

BACKGROUND OF THE INVENTION

1. Field of the Invention

The present invention relates to a fire extinguisher in which the main discharge valve controlling the discharge of extinguishing agent from pressure vessel can be fully controlled from the outlet end end of the discharge hose.

2. The Prior Art

Most conventional fire extinguishing units utilize delivery hoses connected to the extinguishing agent pressure vessel and a manually actuated discharge valve between the vessel and the inlet end of the delivery hose and, in some cases, a manually actuated discharge at the outlet end of the delivery hose. This arrangement requires the operator to use both hands to hold the delivery hose and to operate the discharge valve. In all instances, the valve at the vessel end of the hose must be opened before the extinguisher can be operated.

In extinguisher units of the type having a valve in the head of the pressure vessel and at the outlet end of the hose, when the valve is turned off at the end of the hose prior to closure of the valve leading from the pressure vessel to the hose, if the extinguishing agent is a dry chemical, the latter may become packed in the discharge hose, creating a difficult maintainence problem.

Frequently after pressure extinguishers have been stored for some time, the dry chemical has a tendency to come out in gobs rather than in fluid form.

In checking pressure in fire extinguishers, the question frequently arises as to whether the pressure gauge is recording the actual pressure in the pressure vessel or is stuck on the high side due to the accumulation of gas in the gauge from a previous test.

SUMMARY OF THE INVENTION

The present invention is broadly directed to a fire extinguisher in which the valve controlling discharge of the extinguishing agent from the pressure vessel to the delivery hose is controlled by a control device at the outlet or nozzle end of the delivery hose.

Another feature of the invention is the provision of a second valve in the discharge conduit leading from the pressure vessel to the delivery hose, means for introducing gas pressure from the pressure vessel to the conduit between the first valve and the second valve therein and means for opening the second valve independent of the first valve to permit the pressurized gas introduced therebetween to purge the delivery hose of dry chemical extinguishing agent accumulated therein.

An additional feature of the invention is the provision of means for fluidizing dry chemical and preventing it from coming out in gobs, which consists of introducing pressure from the top of the pressure vessel into the discharge conduit between the first and second valves therein substantially at right angles to the direction of discharge, thus causing turbulence in the discharge and breaking up and fluidizing any aggregations or gobs of dry chemical.

A further feature of the invention is the provision of a filter in the gas pressure take-off line to prevent the passage of dry chemical into that line and the possibility of clogging of the pressure regulator and other elements fed by that line.

BRIEF DESCRIPTION OF THE DRAWING

The drawing schematically illustrates a fire extinguisher embodying the invention.

DETAILED DESCRIPTION OF THE INVENTION

The fire extinguisher comprises a pressure vessel 1 containing a conventional extinguishing agent such as a dry chemical. Pressurized gas is introduced into pressure vessel 1 through fill valve 3 on instrument panel 4 and line 5, and may be any propellant gas conventionally employed, such as nitrogen or carbon dioxide.

The desired gas pressure may be read on pressure gauge 7 on instrument panel 4. For assuring an accurate reading on the pressure gauge, a manually actuated three-way valve 9 having a push button protruding through instrument panel 4 and an exhaust port 11 is connected in line 13 between tank 1 and pressure gauge 7. With this arrangement, by manually actuating valve 9 any pressure remaining in the gauge from a previous test which might keep the gauge stuck at a higher than actual pressure reading can be exhausted through valve 9, and by releasing valve 9 gas from the tank is permitted to flow into the gauge and cause the latter to indicate the actual pressure in pressure vessel 1.

For discharging the extinguishing agent from pressure vessel 1, the vessel is formed with an extinguishing agent discharge conduit 15 communicating with a delivery hose 17 and including main discharge control valve 19, typically consisting of a one-quarter-turn ball valve. Main discharge control valve 19 is opened and closed by pneumatic cylinder 21, which is pivotally anchored at 22 to an upstanding bracket 24 on the pressure vessel and the piston rod 23 of cylinder 21 is connected to operating arm 25 of valve 19.

Pneumatic cylinder 21 is operated by pressurized gas supplied through remotely operated valve 27. Remotely operated valve 27 is a three-way pneumatically actuated valve with its ports connected respectively by lines 29 and 31 to opposite ends of cylinder 21 and its inlet port connected to pressure line 33. Normally remotely operated valve 27 is resiliently held in position to maintain pressure in line 31 and to exhaust line 29, such that main discharge control valve 19 is maintained closed.

To make it possible for the operator of the extinguisher to control main valve 19 from the outlet end of the delivery hose and thus make it unnecessary for him to manually open main valve 19, gas pressure from vessel 1 passes through pressure take-off line 35, line 37, pressure regulator 39, and line 41 to fingertip control valve 43 at the outlet end of the discharge hose and thence via line 45 to the operating port on valve 27. A filter 36 at the beginning of pressure take-off line 35 prevents the passage of dry chemical into the pressure take-off line and protects pressure regulator 39 from the entry of dry chemical. As long as valve 43 remains closed, remotely operated valve 27 remains in its normal condition, maintaining pneumatic cylinder 21 in its normal position whereby main discharge control valve 19 is held closed.

For providing gas pressure to the inlet port of valve 27, a line 47 connects pressure regulator 39 to manually actuated three-way arming valve 49, the outlet ports 51 and 53 of which are connected respectively by lines 55 and 57 to the opposite ends of a pneumatic cylinder 59, and line 57 in turn is connected by a line 61 to pressure inlet line 33 communicating with remotely operated three-way valve 27. Thus, by actuating valve 49, which normally provides pressurized gas through its outlet port 53 and line 55 to the right hand end of pneumatic cylinder 59, port 53 is closed and port 51 is opened to permit the passage of gas pressure via line 57 to the left hand end of pneumatic cylinder 59 and to line 61 leading to the pressure side of valve 27. By pressing on valve 43, the operator can cause remotely operated valve 27 to pressurize line 29 and exhaust line 31, to thereby cause cylinder 21 to open main discharge control valve 19 and thus cause the discharge of extinguishing agent through delivery hose 17. When the pressure on valve 43 is released by the operator, remotely operated valve 27 stops the flow of pressure through line 29 to cylinder 21 and initiates the flow of pressure through line 31 to cylinder 21, thereby to return main discharge valve 19 to closed condition and stop the flow of gas and chemical from the pressure vessel 1 into and through delivery hose 17.

When the valve at the end of the delivery hose in conventional fire extinguishers is turned off, the pressure from the pressure vessel usually causes dry chemical to become packed in the hose. To prevent clogging of the delivery hose by purging it of accumulated dry chemical, a one-quarter-turn pressure control valve 63 is mounted in pressure take-off line 35 posterior to filter 36 and communicates via line 65 with the discharge conduit which it intersects at a right angle at 67, main discharge posterior to valve 19, and a second discharge valve 69 also of the one-wuarter-turn ball type is mounted posterior thereto in the discharge conduit. A pneumatic cylinder 71 pivotally anchored at 72 to bracket 24 has a piston rod 73 connected to an operating arm 75 of valve 69 and a second remotely operated three-way valve 77 has its outlet ports connected respectively by lines 79 and 81 to the opposite ends of cylinder 71. A branch 83 of line 45 connects with a shuttle valve 85 on the operating port of valve 77, such that when valve 43 at the nozzle end of the discharge hose 17 is manually opened by the operator to open main valve 19, gas will pass through branch line 83 into valve 77 and thereby cause pressurized gas to flow through line 81 to cylinder 71 and open valve 69, thus assuring that whenever main discharge valve 19 is opened, valve 69 will also be opened. Correspondingly, whenever manual pressure on valve 43 is released, the drop in pressure in line 45 will permit valves 27 and 77 to cause cylinders 21 and 71 to close discharge control valves 19 and 69.

When manually actuated valve 49 is moved to the operating position, as mentioned above, the right hand end of pneumatic cylinder 59 is exhausted through line 55 and pressure is applied to the left end of cylinder 59 through line 57. Cylinder 59 is pivotally anchored at 86 to a bracket 87 on the pressure vessel and its piston rod 89 connected to operating arm 91 on valve 63, thereby opening the latter and causing gas to pass through line 65 into discharge conduit at 67.

After main discharge valves 19 and 69 are closed by release of pressure on remote operating valve 43, the gas pressure through line 65 into the discharge conduit at 67 can be utilized to purge the hose of accumulated dry chemical. To effect this, a manually actuated three-way purge valve 93 on instrument panel 4 receives pressure from line 41 and is connected by a line 95 to shuttle valve 85 on remotely operated three-way valve 77, so that by actuating valve 93 gas pressure will be introduced through line 95 and shuttle valve 85 into remotely operated valve 77, causing the latter to introduce gas pressure into line 81 and exhaust line 79. This causes cylinder 71 to open valve 69 in the discharge conduit and permit gas pressure through valve 63 and line 65 to loosen any accumulated dry chemical in discharge hose 17. Since main valve 19 is closed additional dry chemical is not introduced into the hose. As soon as the purging has been completed, purge valve 93 can be released, thereby venting the pressure in line 95 and permitting valve 77 to return to its normal position for closing second discharge control valve 69 in the discharge conduit.

In addition to its use, as described above, to purge the delivery hose of accumulated dry chemical, gas pressure through pressure take-off line 35, valve 63 and line 65 can be utilized, when both valves 19 and 69 are opened to discharge dry chemical through hose 17, to break up gobs or lumps of dry chemical which pass from the tank into the discharge conduit. This is accomplished by the turbulence in region 67 of the discharge conduit between valves 19 and 69 by the introduction of pressure from line 65 at right angles to the discharge pressure in the discharge conduit. Thus any gobs of dry chemical which may have entered the discharge conduit from the pressure vessel are broken up and the dry chemical completely fluidized prior to entry into the delivery hose.

Operation of the extinguisher is as follows: When it is desired to use the extinguisher, it is armed by manually flipping valve 49 to the left which, through lines 55 and 57, energizes pneumatic cylinder 59 to open pressure control valve 63 and thereby admit pressure to region 67 of discharge conduit 15. At the same time, the operation of valve 49 introduces pressure through line 61 to the inlet sides of remotely operated three-way valves 27 and 77.

The extinguisher can then be operated by the operator actuating valve 43 at the outlet end of the delivery hose. This causes pressure from the pressure vessel through lines 35, 37, pressure regulator 39, line 41, valve 43 and lines 45 and 83 to operate remotely operated valves 27 and 77, causing them respectively to pressurize lines 29 and 79 and exhaust lines 31 and 81 to cylinders 21 and 71 which are thereby energized to open discharge control valves 19 and 69 and permit the gas pressure in pressure vessel 1 to discharge dry chemical extinguishing agent through discharge conduit 15 and delivery hose 17.

During such discharge, pressure in take-off line 35 passes through filter 36, open pressure valve 63 and line 65 into section 67 of discharge conduit 15 between valves 19 and 69. Since pressure from line 65 intersects the flow of dry chemical through section 67, at right angles, it creates turbulence in the discharge conduit at section 67, tending to break up any gobs or lumps of dry chemical and completely fluidize the same for discharge through delivery hose 17.

When the fire is extinguished, the operator releases valve 43 at the outlet end of the delivery hose, thereby exhausting pressure lines 45 and 83 to remotely operated valves 27 and 77 and permitting these valves to return to their normal position, wherein lines 29 and 79 are exhausted and lines 31 and 81 are pressurized to cause cylinders 21 and 71 to close discharge control valves 19 and 69, thus shutting off discharge of dry chemical agent through discharge conduit 15 and delivery hose 17.

After discharge of the dry chemical has been terminated by closure of chambers 19 and 69, any dry chemical accumulated in the delivery hose may be purged by manually actuating valve 93 to pressurize line 95 which causes remotely operated valve 77 to operate and pressurize line 79 and exhaust line 81 to pneumatic cylinder 71 thereby causing the latter to open valve 69 in the discharge conduit. Since main discharge control valve 19 remains closed, pressure from line 65 will be introduced into section 67 of discharge conduit 15 and since the point of introduction is posterior to main discharge control valve 19 no additional dry chemical will be introduced into the discharge conduit and the pressure introduced through line 65 will loosen and discharge any accumulated dry chemical in delivery hose 17.

The details of the extinguisher may be varied substantially without departing from the spirit of the invention and the exclusive use of those modifications as come within the scope of the claims is contemplated.

I claim:

1. A fire extinguisher comprising a pressure vessel containing an extinguishing agent and pressurized gas, a discharge conduit, a delivery hose having an inlet end connected to said discharge conduit and an outlet at its other end, a normally closed main discharge control valve in said discharge conduit, manually actuated remote control means on said delivery hose adjacent the outlet end thereof, power means operatively connected to said main discharge control valve for opening and closing the same, and means operatively connecting said manually actuated remote control means and said power means for opening said main discharge control valve responsive to release of said control means, said discharge conduit being closeable only when said main discharge control valve is closed a second valve in said discharge conduit between said main discharge control valve and said delivery hose inlet end, normally closed and opened in unison with said main discharge valve, and a pressure takeoff line connecting said pressure vessel with said discharge conduit between said main discharge control valve and said second valve, said second valve being selectably openable when said main discharge valve is closed to permit pressurized gas from said pressure takeoff line to pass into and through said delivery hose whereby to purge the same of any extinguishing agent accumulated therein.

2. A fire extinguisher according to claim 1, including a normally closed pressure take-off control valve in said pressure take-off line and means for opening said pressure take-off control valve.

3. A fire extinguisher according to claim 1, wherein said power means comprises a pneumatic cylinder and said means operatively connecting said manually actuated remote control means and said power means comprises a remotely operated valve providing a pressure connection to said cylinder, said manually actuated remote control means comprising a manually actuated valve, a pressure take-off line connecting said pressure vessel to said manually actuated valve and another line connecting said manually actuated valve to said remotely operated valve, whereby, responsive to manual actuation of said manually actuated valve, pressurized gas causes operation of said remotely operated valve to cause said cylinder to open said main discharge control valve, and release of said manually actuated valve causes said remotely operated valve to close said main discharge control valve.

4. A fire extinguisher according to claim 3, wherein said pressure take-off line from said pressure vessel has a branch line connected to said discharge conduit between said main discharge control valve therein and the inlet end of said delivery hose.

5. A fire extinguisher according to claim 4, including, power means operatively connected to said second valve in said discharge conduit for opening and closing the same, means operatively connecting said manually actuated remote control means and said power means for opening and closing said second valve in said discharge conduit in unison with said main discharge control valve, and additional manually actuated remote control means for opening said second valve in said discharge conduit when said main discharge control valve remains closed.

6. A fire extinguisher according to claim 5, wherein said power means for operating said second valve in said discharge conduit comprises a second pneumatic cylinder and said means operatively connecting said first-named manually actuated remote control means and said last-named power means comprises a second remotely operated valve providing a pressure connection to said second cylinder, said additional manually actuated remote control means comprising a second manually-actuated valve, a connection from said pressure take-off line to said second manually actuated valve and a separate line from said second manually actuated valve to said second remotely operated valve, whereby responsive to manual actuation of said second manually actuated valve pressurized gas causes operation of said second remotely operated valve to cause said second cylinder to open said second valve in said discharge conduit and release of said second manually actuated valve causes said remotely operated valve to close said second valve in said discharge conduit.

7. A fire extinguisher according to claim 3, including a filter in said pressure take-off line, a pressure regulator in said pressure take-off line posterior to said filter and anterior to said manually actuated valve.

8. A fire extinguisher according to claim 7, including a valve in said pressure take-off branch line anterior to the connection of said pressure take-off branch line to said discharge conduit.

9. A fire extinguisher according to claim 8, including a manually actuated normally closed arming valve in said pressure take-off line posterior to said pressure regulator, and a line leading from said arming valve to the pressure inlet port of said remotely operated valve.

10. A fire extinguisher according to claim 9, including a third pneumatic cylinder operatively connected to said valve in said pressure take-off branch line, said line leading from said arming valve having a branch to said third pneumatic cylinder for opening said valve in said pressure take-off branch line when said arming valve is manually actuated, there being a second line from said arming valve to the opposite end of said third pneumatic cylinder whereby upon release of said arming valve said third pneumatic cylinder closes said valve in said pressure take-off branch line.

11. A fire extinguisher according to claim 10, wherein said first and second pneumatic cylinders are double acting cylinders and said first and second remotely operated valves have pressure lines respectively connected to the opposite ends of said first and second pneumatic cylinders from the first pressure connections thereto for closing said main discharge control valve and said second responsive to return of said first and second remotely operated valves to their normal positions caused by release of said first and second manually actuated valves.

12. A fire extinguisher according to claim 1, including a pressure gauge, a line connecting said pressure gauge to said pressure vessel, and a manually actuated three-way valve in said line connecting said pressure gauge to said pressure vessel, said valve normally providing communication between said pressure vessel and said gauge and having an exhaust port communicable with said gauge by actuation of said valve, whereby to permit selective evacuation of said gauge prior to checking pressure thereon by manual actuation of said valve.

* * * * *